219-121 CROSS REFERENCE SEARCH RO

United States Patent [19]

Britt

[11] 3,977,191

[45] Aug. 31, 1976

[54] ATOMIC EXPANSION REFLEX OPTICS POWER OPTICS POWER SOURCE (AEROPS) ENGINE

[76] Inventor: Robert Gordon Britt, 313 W. Fisher St., Salisbury, N.C. 28144

[22] Filed: Aug. 14, 1974

[21] Appl. No.: 497,335

[52] U.S. Cl. ..... 60/509; 60/513; 60/721; 219/121 P; 313/226

[51] Int. Cl.[2] ..... F01K 25/06

[58] Field of Search ..... 60/508–515, 60/651, 671, 650, 680, 669; 313/226; 219/21 P

[56] References Cited

UNITED STATES PATENTS 3,398,686 8/1968 Guin ..... 60/513 X 3,609,965 10/1971 Hercher ..... 60/513

*Primary Examiner*—Allen M. Ostrager

[57] ABSTRACT

An engine is provided which will greatly reduce atmospheric pollution and noise by providing a sealed system engine power source which has no exhaust nor intake ports. The engine includes a spherical hollow pressure chamber which is provided with a reflecting mirror surface. A noble gas mixture within the chamber is energized by electrodes and work is derived from the expansion of the gas mixture against a piston.

12 Claims, 7 Drawing Figures

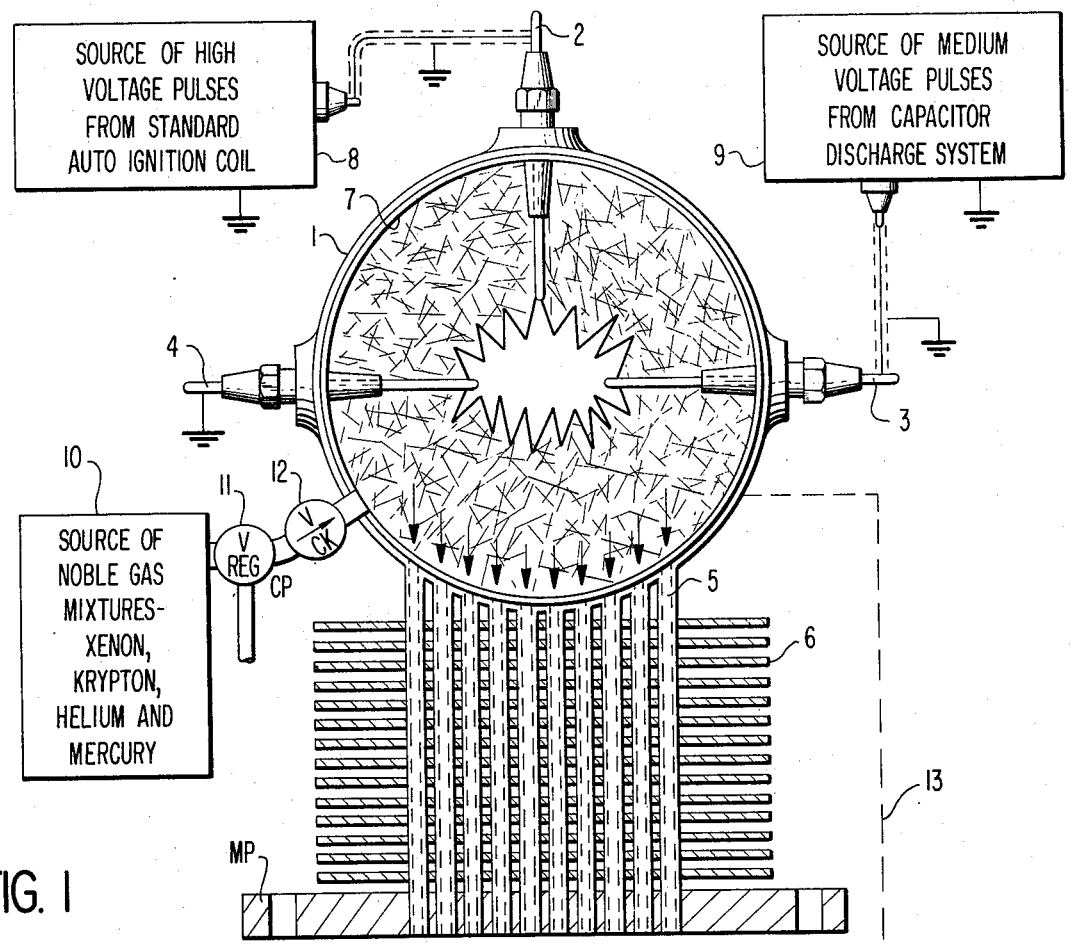
FIG. 1
FIG. 3
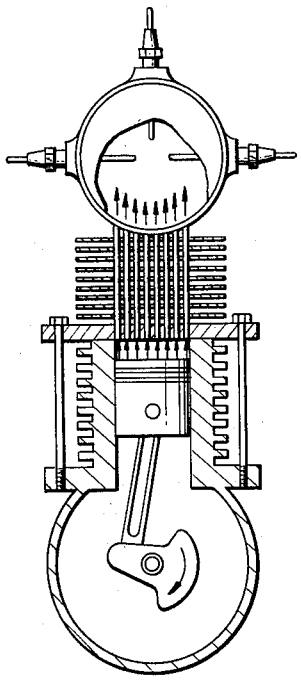
COMPRESSION STROKE
FIG. 2
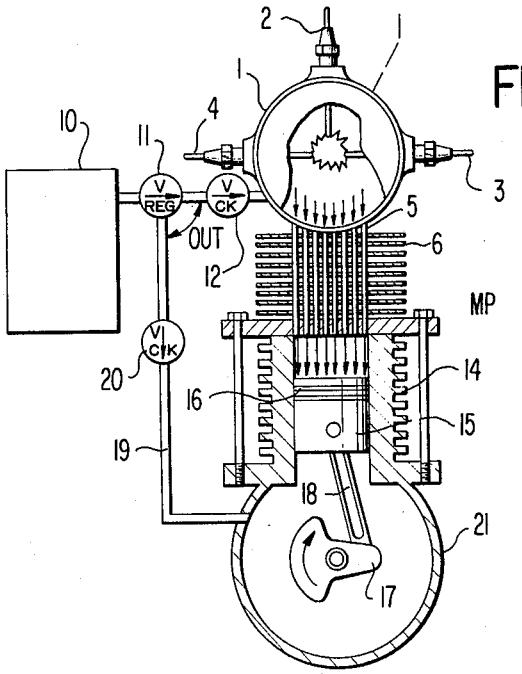
POWER STROKE

ATOMIC EXPANSION REFLEX OPTICS POWER OPTICS POWER SOURCE (AEROPS) ENGINE

SUMMARY OF INVENTION

An atomic expansion reflex optics power source (AEROPS) engine, having a central crankshaft surrounded by a crankcase. The crankcase has a number of cylinders and a number of pistons located within the cylinders. The pistons are connected to the crankshaft by a number of connecting rods. As the crankshaft turns, the pistons move in a reciprocating motion within the cylinders. An assembly consisting of a number of hollow spherical pressure chambers, having a number of electrodes and hollow tubes, with aircooling fins, is mounted on the top of each cylinder. The necessary gaskets are provided as needed to seal the complete engine assemblies from atmospheric pressure. A means is provided to charge the hollow spherical pressure chamber assembly and the engine crankcase with noble gas mixtures through a series of valves and tubes. A source of medium voltage pulses is applied to two of the electrodes extending into each of the hollow spherical pressure chambers. When a source of high voltage pulses is applied from an electrical rotary distributor switch to other electrodes extending into each of the hollow spherical pressure chambers in a continuous firing order, electrical discharges take place periodically in the various hollow spherical pressure chambers. When the electrical discharges take place, high energy photons are released on many different electromagnetic frequencies. The photons strike the atoms of the various mixed gases, e.g., xenon, krypton, helium and mercury, at different electromagnetic frequencies to which each is selectively sensitive, and the atoms become excited. The first photons emitted are reflected back into the mass of excited atoms by a reflecting mirror surface on the inside wall of any particular hollow spherical pressure chamber, and this triggers more photons to be released by these atoms. They are reflected likewise and strike other atoms into excitation and photon energy release. The electrons orbiting around the protons of each excited atom in any hollow spherical pressure chamber increase in speed and expand outward from center via centrifugal force causing the atoms to enlarge in size. Consequently, a pressure wave is developed, the gases expand and the pressure of the gas increases. As the gases expand, the increased pressure is applied to the top of the pistons in the various cylinders fired selectively by the electrical distributor. The force periodically applied to the pistons is transmitted to the connecting rods which turn the crankshaft to produce rotary power. Throttle control valves and connecting tubes form a bypass between opposing hollow spherical pressure chambers of each engine section thereby providing a means of controlling engine speed and power. The means whereby the excited atoms are returned to normal minimum energy ground-state and minimum pressure level, is provided by disrupting the electrical discharge between the medium voltage electrodes, by cooling the atoms as they pass through a heat transfer assembly, and by the increase in the volume area above the pistons at the bottom of their power stroke. The AEROPS engine as described above provides a sealed unit power source which has no atmospheric air intake nor exhaust emission. The AEROPS engine is therefore pollution free.

BRIEF OBJECTIVE OF THE INVENTION

This invention relates to the development of an atomic expansion reflex optics power source (AEROPS) engine, having the advantages of greater safety, economy and efficiency over those disclosed in the prior art.

The principal object of this invention is to provide a new engine power technology which will greatly reduce atmospheric pollution and noise, by providing a sealed system engine power source which has no exhaust nor intake ports.

Engine power is provided by expanding the atoms of various noble gas mixtures. The pressure of the gases increases periodically to drive the pistons and crankshaft in the engine to produce safe rotary power.

The objects and other advantages of this invention will become better understood to those skilled in the art when viewed in light of the accompanying drawings.

BRIEF DESCRIPTION OF THE DRAWING VIEWS

Other objects, advantages and features should become apparent from the following disclosure wherein:

FIG. 1 is an elevational view of the hollow spherical pressure chamber assembly, including sources of gas mixtures and electrical supply.

FIG. 2 is an elevational view of the primary engine power stroke.

FIG. 3 is an elevational view of the primary engine compression stroke.

DETAILED DESCRIPTION

Figure 4:
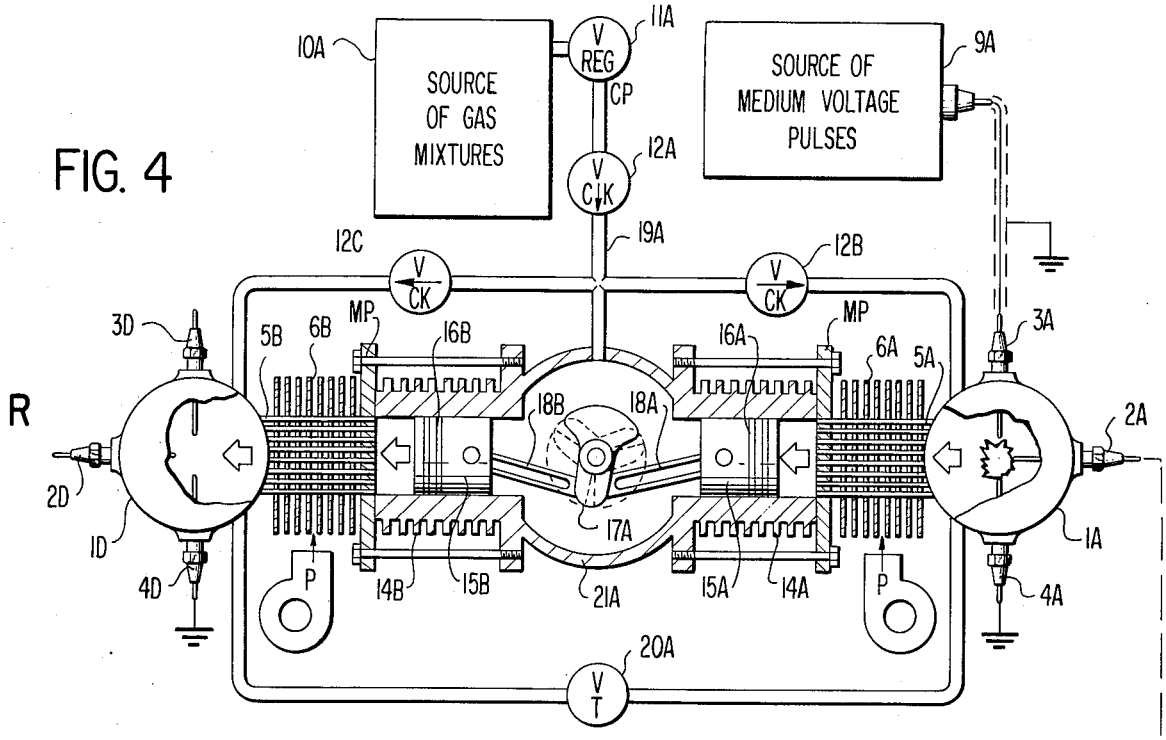
FIG. 4 is a rear elevational view of a six cylinder AEROPS engine.

Referring now to FIG. 1 of the drawings, the AEROPS engine comprises a hollow spherical pressure chamber 1 having an insulated high voltage electrode 2 mounted on the top, an insulated medium voltage electrode 3 mounted on the right, and an insulated common ground electrode 4 mounted on the left, as shown in this particular view. Electrodes 2, 3, and 4 extend through the wall of the hollow spherical pressure chamber 1 and each electrode forms a pressure seal. A plurality of hollow tubes 5 arranged in a cylindrical pattern extend through the wall of the hollow spherical pressure chamber 1, and each hollow tube is welded to said pressure chamber to form a pressure seal. The opposite ends of hollow tubes 5 extend through the mounting plate MP and are welded likewise to form a pressure seal. A plurality of heat transfer fins 6 are welded at intervals along the length of said hollow tubes 5. A bright reflecting mirror surface 7 is provided on the inner wall of the hollow spherical pressure chamber 1. A source of high voltage 8 is periodically connected to the insulated high voltage electrodes 2 and 4. A source of medium voltage 9 from a discharge capacitor is connected to the insulated medium voltage electrodes 3 and 4. A source of noble gas mixtures 10, e.g., xenon, krypton, helium and mercury is applied under pressure into the hollow spherical pressure chamber 1 through pressure regulator valve 11 and check valve 12.

Referring now to FIG. 2 of the drawings, the complete assembly shown in FIG. 1 by reference to dotted line 13, is mounted on the top of the cylinder 14 via mounting plate MP. The necessary gaskets or other means are provided to seal the engine and prevent loss of gases into the atmosphere. The piston 15 located within cylinder 14 has several rings 16 which seal against the inner wall of said cylinder. The piston 15 is connected to the crankshaft 17 by connecting rod 18. The source of noble gas mixtures 10 is applied under pressure into the crankcase 21 through pressure regulator valve 11, check valve 12 and capillary tube 19. The piston 15 is now balanced between equal gas pressures. Assuming that the engine is running and the piston 15 is just passing top-dead-center (TDC), a source of medium voltage from a capacitor discharge system 9 (FIG. 6, a single typical capacitor section) is applied to electrodes 3 and 4. A source of high voltage pulses from a standard ignition coil 8 (such as shown in FIG. 7) is applied to electrodes 2 and 4 and the gases within the hollow spherical pressure chamber 1 are ionized and made electrically conductive. An electrical discharge takes place between electrodes 3 and 4 through the gases in the hollow spherical pressure chamber 1. The electrical discharge releases high energy photons on many different electromagnetic frequencies. The photons strike the atoms of the various gases, e.g., xenon, krypton, helium and mercury at different electromagnetic frequencies to which each atom is selectively sensitive and the atoms of each gas become excited. The first photons emitted are reflected back into the mass of excited atoms by the reflecting mirror surface 7. This triggers more photons to be released by these atoms, and they are reflected likewise from the mirror surface 7 and strike other atoms into excitation and more photons are released as the chain reaction progresses. The electrons orbiting around the protons of each excited atom increase in speed and expand outward in a new orbital pattern due to an increase in centrifugal force. Consequently, a pressure wave is developed in the gases as the atoms expand and the overall pressure of the gases within the hollow spherical pressure chamber 1 increases. As the gases expand they pass through the hollow tubes 5 and apply pressure on the top of piston 15. The pressure pushes the piston 15 and the force and motion of the piston is transmitted through the connecting rod 18 to the crankshaft 17 rotating it in a clockwise direction. At this point of operation, the power stroke is completed and the capacitor in the medium voltage capacitor discharge system 9 is discharged. The excited atoms return to normal ground state and the gases return to normal pressure level. The capacitor in the medium voltage capacitor discharge system 9 is recharged during the time period between (TDC) power strokes.

Referring now to FIG. 3 of the drawings, the compression stroke of the engine is shown. In this engine cycle the gases above the piston are forced back into the hollow spherical pressure chamber through the tubes of the heat transfer assembly. The gases are cooled as the heat is conducted into the fins of the heat transfer assembly and carried away by an air blast passing through the fins. An example is shown in FIG. 4, the centrifugal air pump P providing an air blast upon like fins.

Figure 5:
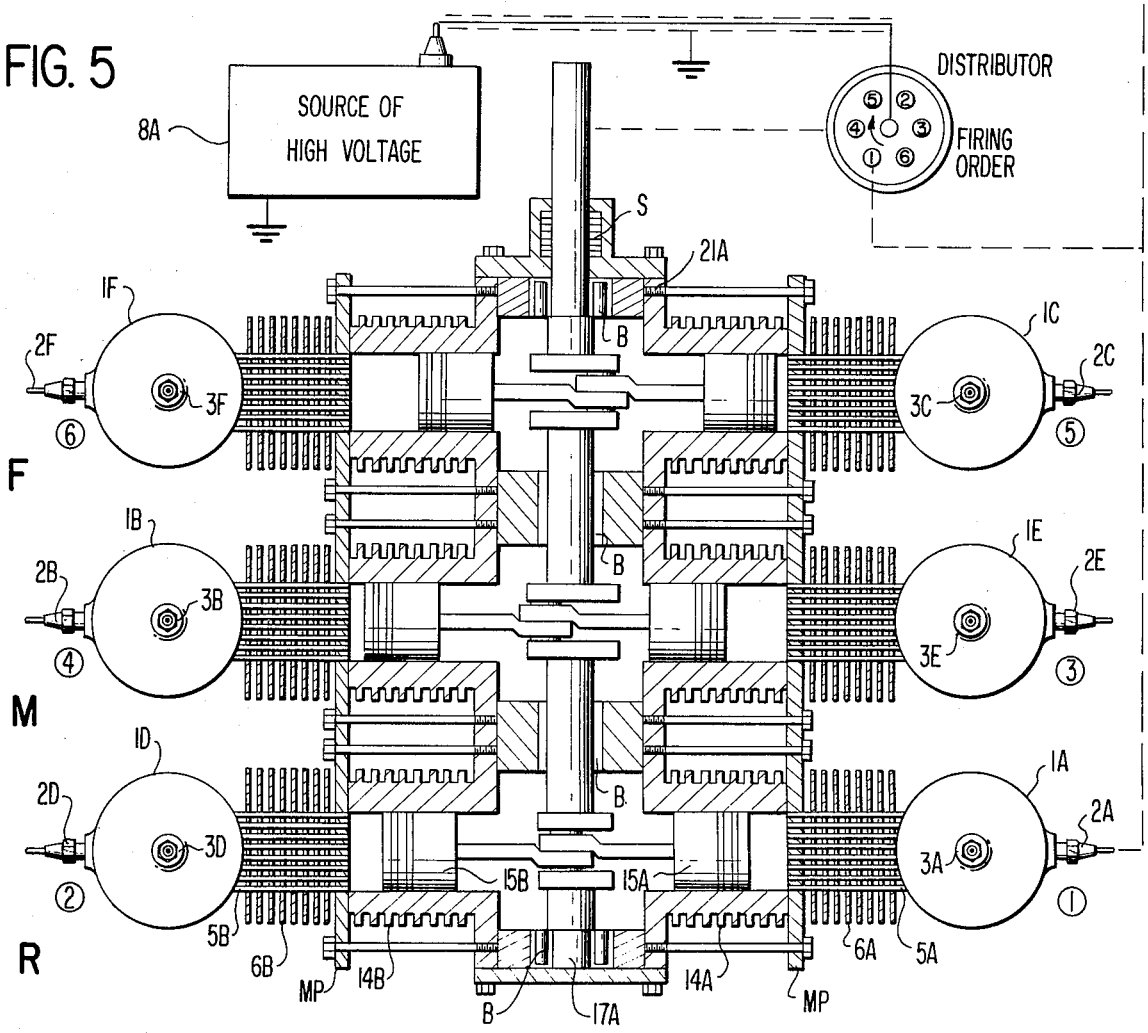
FIG. 5 is a top view of the six cylinder AEROPS engine.

Some of the basic elements of the invention as set forth in FIGS. 1, 2, and 3 are now exhibited in FIGS. 4 and 5 of the drawings which show complete details of a six cylinder horizontally opposed AEROPS engine.

Referring now to FIGS. 4 and 5 of the drawings, FIG. 4 is a view of the rear section of the engine showing the crankshaft center axis and two of the horizontally opposed cylinders. In as much as the rear R, middle M and front F sections of the engine possess identical features, only the rear R engine section will be elaborated upon in detail in order to prevent repetition and in the interest of simplification. The crankshaft 17A consists of three cranks spaced 120° apart in a 360° circle as shown. Both connecting rods 18A and 18B are connected to the same crank. Their opposite ends connect to pistons 15A and 15B, located in cylinders 14A and 14B respectively. Each piston has pressure sealing rings 16A and 16B. The hollow spherical pressure chamber assemblies consisting of 1A and 1D are mounted on cylinders 14A and 14B via mounting plates MP. The necessary gaskets are provided as needed to seal the complete engine assemblies from atmospheric pressure. The source of gas mixtures 10A is applied under pressure to pressure regulator valve 11A and flows through check valve 12A, through check valve 12B to the hollow spherical pressure chamber 1A, and through check valve 12C to the hollow spherical pressure chamber 1D. The gas flow network consisting of capillary tubes below point 19A represents the flow of gases to the rear section R of the engine. The middle section M and the front section F both have gas flow networks identical to that consisting of capillary tubes below point 19A, while the gas flow network above is common to all engine sections. Throttle valve 20A and the connecting tubing form a variable bypass between hollow spherical pressure chambers 1A and 1D to control engine speed and power. Engine sections R, M and F each have this bypass throttle network. The three throttle valves have their control shafts ganged together. A source of medium voltage pulses 9A is connected to medium voltage electrodes 3A and 3D. In one particular embodiment the medium voltage is 500 volts. A source of high voltage pulses 8A is connected to electrode 2A through the distributor as shown. Electrode 4A is connected to common ground. Centrifugal air pumps P force air through heat transfer fins 6A and 6B to cool the gases flowing in the tubes 5A and 5B.

FIG. 5 is a top view of the AEROPS engine showing the six cylinders and crankshaft arrangement consisting of the rear R, middle M and front F sections. The crankshaft 17A is mounted on bearings B, and a multiple shaft seal S is provided as well as the necessary seals at other points to prevent loss of gases into the atmosphere. The hollow spherical pressure chambers 1A, 1B, 1C, 1D, 1E and 1F are shown in detail with high voltage electrodes 2A, 2B, 2C, 2D, 2E, 2F and medium voltage electrodes 3A, 3B, 3C, 3E and 3F. The common ground electrodes 4A, 4B, 4C, 4D, 4E, 4F are not shown in FIG. 5 but are typical of the common ground electrodes 4A and 4D shown in FIG. 4. It should be noted that the cranks on crankshaft 17A are so arranged to provide directly opposing cylinders rather than a conventional staggered cylinder design.

Figure 6:
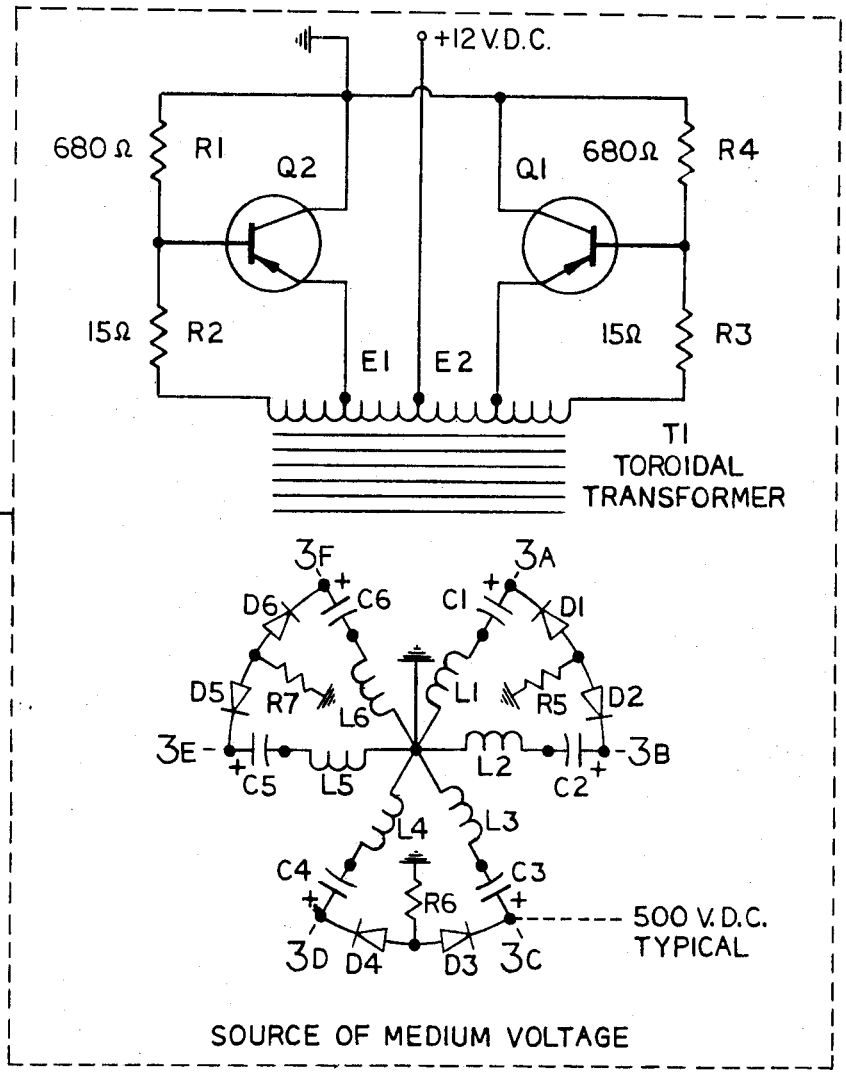
FIG. 6 is an electrical schematic of the source of medium voltage.
Figure 7:
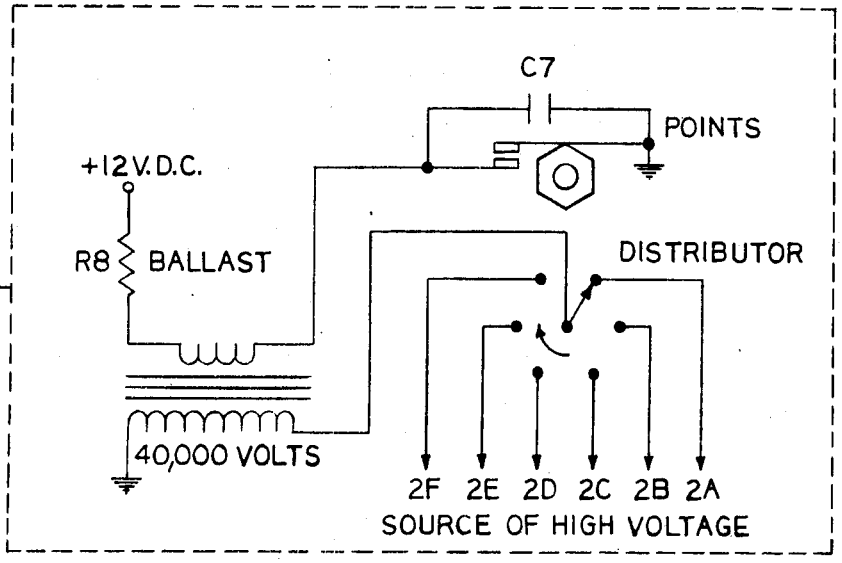
FIG. 7 is an electrical schematic of the source of high voltage.

FIG. 6 is an electrical schematic of the source of medium voltage 9A. The complete operation of the converter is explained as follows: The battery voltage 12VDC is applied to transformer T1, which causes currents to pass through resistors R1, R2, R3 and R4. Since it is not possible for these two paths to be exactly equal in resistance, one-half of the primary winding of T1 will have a somewhat higher current flow. Assuming that the current through the upper half of the primary winding is slightly higher than the current through the lower half, the voltages developed in the two feedback windings (the ends connected to R3 and R2) tend to turn transistor Q2 on and transistor Q1 off. The increased conduction of Q2 causes additional current to flow through the lower half of the transformer primary winding. The increase in current induces voltages in the feedback windings which further drives Q2 into conduction and Q1 into cutoff, simultaneously transferring energy to the secondary of T1. When the current through the lower half of the primary winding of T1 reaches a point where it can no longer increase due to the resistance of the primary circuit and saturation of the transformer core, the signal applied to the transistor from the feedback winding drops to zero, thereby turning Q2 off. The current in this portion of the primary winding drops immediately, causing a collapse of the field about the windings of T1. This collapse in field flux, cutting across all of the windings in the transformer, developes voltages in the transformer windings that are opposite in polarity to the voltages developed by the original field. This new voltage now drives Q2 into cutoff and drives Q1 into conduction. The collapsing field simultaneously delivers power to the secondary windings L1, L2, L3, L4, L5 and L6. The output voltage of each winding is connected through resistors R5, R6 and R7 and diode rectifiers D1, D2, D3, D4, D5 and D6, respectively, whereby capacitors C1, C2, C3, C4, C5 and C6 are charged with a medium voltage potential of the polarity shown. The output voltage is made available at points 3A, 3B, 3C, 3D, 3E and 3F which are connected to the respective medium voltage electrodes on the engine shown in FIG. 4 and FIG. 5.

Referring now to FIG. 7 of the drawings, a conventional "Kettering" ignition system provides a source of high voltage pulses 8A of approximately 40,000 volts to a distributor, which provides selective voltage output at 2A, 2B, 2C, 2D, 2E and 2F, which are connected to the respective high voltage electrodes on the engine shown in FIG. 4 and FIG. 5. The distributor is driven by the engine crankshaft 17A (FIG. 5) at a one to one mechanical gear ratio.

Referring again to FIGS. 4 and 5 of the drawings, the operation of the engine is as follows: Assuming that a source of noble gas mixtures, e.g., xenon, krypton, helium and mercury is applied under pressure to the hollow spherical pressure chambers 1A, 1B, 1C, 1D, 1E and 1F and internally to the crankcase 21A through pressure regulator valve 11A and check valves 12A, 12B and 12C; and the source of medium voltage 9A is applied to electrodes 3A, 3B, 3C, 3D, 3E and 3F; and a source of high voltage pulse 8A is applied to electrode 2A through the timing distributor, the gas mixtures in the hollow spherical pressure chamber 1A is ionized and an electrical discharge occurs immediately between electrodes 3A and 4A. High energy photons are released on many different electromagnetic frequencies. The photons strike the atoms of the various gases, e.g., xenon, krypton, helium and mercury at different electromagnetic frequencies to which each is particularly sensitive and the atoms of each gas become excited. The first photons emitted are reflected back into the mass of excited atoms by the internal reflecting mirror surface on the inside wall of the hollow spherical pressure chamber 1A. This triggers more photons to be released by these atoms and they are reflected likewise from the mirror surface and strike other atoms into excitation and more photons are released as the chain reaction progresses. The electrons orbiting around the protons of each excited atom in the hollow spherical pressure chamber 1A increase in speed and expand outward in a new orbital pattern due to an increase in centrifugal force. Consequently, a pressure wave is developed in the gases as the atoms expand and the overall pressure of the gases within the hollow spherical pressure chamber 1A increases. As the gases expand they pass through the hollow tubes 5A applying pressure on the top of piston 15A. The pressure applied to piston 15A is transmitted through connecting rod 18A to the crankshaft 17A rotating it in a clockwise direction. As the crankshaft 17A rotates it pushes piston 15B via connecting rod 18B in the direction of a compression stroke, forcing the gases on the top of the piston through hollow tubes 5B into the hollow spherical pressure chamber 1D. As the gases pass through the hollow tubes 5A and 5B the heat contained in the gases is conducted into the heat transfer fins 6A and 6B, where it is dissipated by a blast of air passing through said fins from the centrifugal air pumps P. At this point of operation the power stroke of piston 15A is completed and the capacitor in the medium voltage capacitor discharge system 9A is discharged. The excited atoms return to normal ground state and the gases return to normal pressure level. The capacitor in the medium voltage capacitor discharge system 9A is recharged during the time period between the power strokes of piston 15A. The above power stroke cycle occurs exactly the same in the remaining cylinders as the high voltage firing order progresses in respect to the position of the distributor switch. In as much as the AEROPS engine delivers six power strokes per single crankshaft revolution, the crankshaft drives the distributor rotor at a one to one shaft ratio. The complete high voltage firing order is 1, 4, 5, 2, 3, 6, whereas, the high voltage is applied to electrodes 2A, 2B, 2C, 2D, 2E and 2F respectively. A means of controlling engine speed and power is provided by a plurality of throttle control valves and connecting tubes which form a bypass between opposing hollow spherical pressure chambers of each engine section.

The AEROPS engine as described above provides a sealed unit power source which has no atmospheric air intake nor exhaust emission and is therefore pollution free.

What has been set forth above is intended an exemplary to enable those skilled in the art in the practice of the invention. It should, therefore, be understood that, within the scope of the appended claims, the invention may be practiced other than as specifically described.

What is new and therefore desired to be protected by Letters Patent of the United States is:

1. An atomic expansion reflex optics power source comprising:

a plurality of pressure chambers, each having a reflecting mirror surface on its inside wall, and each having heat transfer fins and tubes as an integral part thereof, said plurality of pressure chambers having a plurality of electrodes extending into the inside of said pressure chambers, said electrodes being connected to a source of electrical voltage pulses, said pressure chambers being charged with a noble gas mixture under pressure, and means to generate heat, pressure and power in said noble gas mixture within said plurality of pressure chambers.

2. The power source as set forth in claim 1 wherein said heat transfer fins and tubes comprise a system of pressure tubing leading from said pressure chambers through which said noble gas mixture is free to pass, said pressure tubing having said fins acting as a heat sink.

3. An atomic expansion reflex optics power source (Aerops) engine comprising:

a central crankshaft surrounded by a crankcase;

said crankcase having a cylinder as an integral part thereof;

a piston disposed within said cylinder;

said piston having rings forming a pressure seal against the inside wall of said cylinder;

said piston having a connecting rod communicating with said central crankshaft;

a hollow spherical pressure chamber having a reflecting mirror surface on its inside wall, and having heat transfer fins and tubes as an integral part thereof, mounted on the open end of said cylinder opposite said crankcase forming a seal against atmospheric pressure;

a plurality of electrodes extending into the inside of said hollow spherical pressure chamber, said electrodes having insulators and seals against atmospheric pressure;

a source of high voltage pulses connected to and communicating with said plurality of electrodes;

a source of medium voltage pulses connected to and communicating with said plurality of electrodes;

a source of noble gas mixture under pressure connected to said hollow spherical pressure chamber, said noble gas mixture under pressure within said hollow spherical pressure chamber having ionized atoms, excited atoms and expanded atoms responsive to cyclic electrical discharges and reflecting photon radiation within said hollow spherical pressure chamber, and means for periodically increasing the pressure of said noble gas mixture within said hollow spherical pressure chamber communicating with said cylinder thereby exerting driving forces on the top of said piston communicating with said crankshaft producing rotary power.

4. The engine as set forth in claim 3 wherein said source of high voltage pulses connected to and communicating with said plurality of electrodes comprises means to ionize said noble gas mixture within said hollow spherical pressure chamber causing said noble gas mixture to become electrically conductive.

5. The engine as set forth in claim 3 wherein said source of medium voltage pulses connected to and communicating with said plurality of electrodes comprises means for generating cyclic electrical discharges through said noble gas mixture within said hollow spherical pressure chamber for releasing photon radiation on different electromagnetic frequencies which selectively strike the atoms in said noble gas mixture within said hollow spherical pressure chamber causing said atoms to become excited atoms, said excited atoms releasing additional said photon radiation.

6. The engine as set forth in claim 3 wherein said hollow spherical pressure chamber having a reflecting mirror surface on its inside wall, comprises means for reflecting photon radiation through said noble gas mixture within said hollow spherical pressure chamber developing more said excited atoms and photon radiation in a chain reaction.

7. The engine as set forth in claim 6 wherein said excited atoms in said noble gas mixture within said hollow spherical pressure chamber become expanded atoms subject to increasing centrifugal force responsive to said photon radiation increasing the speed of electrons orbiting around the protons of each said excited atoms comprising means for increasing the pressure of said noble gas mixture.

8. An atomic expansion reflex optics power source (Aerops) engine comprising:

a central crankshaft having a plurality of cranks surrounded by a crankcase;

said crankcase having a plurality of cylinders mounted thereon;

a plurality of pistons disposed within said cylinders;

said pistons having rings forming a pressure seal against the inside wall of the said respective cylinder;

said pistons each having a connecting rod communicating with said central crankshaft;

a plurality of hollow spherical pressure chambers, each having a reflecting mirror surface on its inside wall, and each having heat transfer fins and tubes as an integral part thereof, mounted on the open end of each said respective cylinder opposite said crankcase forming a seal against atmospheric pressure;

a plurality of electrodes extending into the inside of each said plurality of hollow spherical pressure chambers;

a source of high voltage pulses, and a distributor of said high voltage pulses connected to and selectively communicating with said plurality of electrodes in a predetermined order;

a source of medium voltage pulses connected to and communicating with said plurality of electrodes;

a source of noble gas mixture under pressure connected to each said plurality of hollow spherical pressure chambers, said noble gas mixture under pressure within each said plurality of hollow spherical pressure chambers having ionized atoms, excited atoms and expanded atoms responsive to cyclic electrical discharges and reflecting photon radiation, and means for selectively increasing the pressure of said noble gas mixture within each said plurality of hollow spherical pressure chambers communicating with each said respective cylinder thereby exerting driving forces on the top of said pistons communicating with said crankshaft producing rotary power.

9. The engine as set forth in claim 8 wherein said source of high voltage pulses and said distributor connected to and communicating with said plurality of electrodes comprises means for selectively ionizing said noble gas mixture within any said plurality of hollow spherical pressure chambers in a predetermined order causing said noble gas mixture to become electrically conductive.

10. The engine as set forth in claim 8 wherein said source of medium voltage pulses connected to and communicating with said plurality of electrodes comprises means for electrical discharges through said noble gas mixture within any said plurality of hollow spherical pressure chambers for releasing photon radiation on different electromagnetic frequencies which selectively strike the atoms in said noble gas mixture within any said plurality of hollow spherical pressure chambers causing said atoms to become excited atoms, said excited atoms releasing additional photon radiation.

11. The engine as set forth in claim 8 wherein said plurality of hollow spherical pressure chambers each having a reflecting mirror surface on its inside wall, comprises means for reflecting photon radiation through said noble gas mixture within any said hollow spherical pressure chambers developing more said excited atoms and photon radiation in a chain reaction.

12. The engine as set forth in claim 11 wherein said excited atoms in said noble gas mixture within any said plurality of hollow spherical pressure chambers become expanded atoms subject to increasing centrifugal force responsive to said photon radiation increasing the speed of electrons orbiting around the protons of each said excited atoms comprising means for increasing the pressure of said noble gas mixture.

* * * * *

UNITED STATES PATENT OFFICE

CERTIFICATE OF CORRECTION

Patent No. 3,977,191 Dated August 31, 1976

Inventor(s) Robert Gordon Britt

It is certified that error appears in the above-identified patent and that said Letters Patent are hereby corrected as shown below:

On the cover sheet (Item 54) should read:

-- Atomic Expansion Reflex Optics Power Source (Aerops Engine) --.

Signed and Sealed this

Seventh Day of February 1978

[SEAL]

Attest:

RUTH C. MASON
Attesting Officer

LUTRELLE F. PARKER
Acting Commissioner of Patents and Trademarks